US005603667A

United States Patent [19]

Ezaki et al.

[11] Patent Number: 5,603,667

[45] Date of Patent: Feb. 18, 1997

[54] GOLF CLUB HEAD

[75] Inventors: Hiroshi Ezaki, Tokyo; Hidekimi Inoue, Kanagawa-ken; Ryohei Uji, Tokyo; Hirato Shimasaki, Tokyo; Masaomi Hiruta, Tokyo; Hideyuki Ishii, Tokyo, all of Japan

[73] Assignee: Bridgestone Sports Co., Ltd., Tokyo, Japan

[21] Appl. No.: 490,436

[22] Filed: Jun. 12, 1995

Related U.S. Application Data

[63] Continuation-in-part of Ser. No. 174,600, Dec. 28, 1993, abandoned.

[51] Int. Cl.[6] ..... A63B 53/04

[52] U.S. Cl. ..... 473/324; 473/342

[58] Field of Search ..... 473/324–350, 473/282, 287, 291, 251

[56] References Cited

U.S. PATENT DOCUMENTS

| | | |
|---|---|---|
| 3,749,408 | 7/1973 | Mills . |
| 3,901,692 | 8/1975 | Mikawa . |
| 4,801,146 | 1/1989 | Honma . |
| 5,104,457 | 4/1992 | Viljoen . |
| 5,176,384 | 1/1993 | Sata . |
| 5,207,427 | 5/1993 | Saeki . |
| 5,390,184 | 2/1995 | Rudell . |

FOREIGN PATENT DOCUMENTS

| | | |
|---|---|---|
| 63-267376 | 11/1988 | Japan . |
| 1259877 | 10/1989 | Japan . |
| 2080070 | 3/1990 | Japan . |
| 2149279 | 6/1990 | Japan . |

*Primary Examiner*—Sebastiano Passaniti
*Attorney, Agent, or Firm*—Jordan and Hamburg

[57] ABSTRACT

A golf club head of which the face height is larger than the sole width, a so-called "iron" club, having at least the striking face made of a copper or copper alloy or plated with a copper.

3 Claims, 4 Drawing Sheets

GOLF CLUB HEAD

This application is a continuation-in-part of application Ser. No. 08/174,600 filed Dec. 28, 1993, now abandoned.

BACKGROUND OF THE INVENTION

The present invention relates to a novel and improved golf club head of which the face height is larger than the sole width, namely a so-called "iron" club head.

The heads of the conventional golf clubs of this type are made of a material such as stainless steel, iron, synthetic resin or the like, and the striking faces of the club heads are also made of a material such as stainless steel, titanium, iron, carbon fiber-reinforced plastic (CFRP), aluminum or the like.

The conventional golf club heads have not created so much back spin on the ball and so it was difficult with the conventional club head to stop the ball dead, roll it back a short way or check the ball from running on too far when the ball landed on the ground. As shown in FIG. 4, for example, the turning speed of the ball to which a back spin was imparted when the ball was struck by an average golfer A with a No. 9 iron club head made of a soft iron by forging, was 3,800 rpm, and 5,200 rpm by another average golfer B and a professional golfer C.

SUMMARY OF THE INVENTION

The present invention has an object to provide a golf club head which can generate an increased back spin on the ball to effectively check the ball from running too far from its landing position or turn it backwards.

The above object is attained by providing a golf club head of which at least the striking face is made of copper or a copper alloy or is with copper or a copper alloy, the copper or copper alloy optionally being plated with nickel or nickel followed by chromium on the nickel, and the striking face having a hardness of not greater than 60, preferably in the range of 35 to 40, on the Rockwell B scale. All hardness values herein are on the Rockwell B scale.

FIG. 4 also shows the results of the experiments by the Inventor. The turning speed of the ball to which back spin was imparted when the ball was struck by the average golfer A with a club head having a face insert made of copper fixed in the head body made of a stainless steel by forging was 5,100 rpm, which was higher than that when the ball was struck with the No. 9 iron club head made of soft iron by forging. Further, the turning speed of the ball struck by another average golfer B was over 7,000 rpm. Furthermore, the turning speed of the ball struck by the professional golfer C was higher than 9,000 rpm.

DETAILED DESCRIPTION OF THE PREFERRED EMBODIMENTS

The preferred embodiments of the present invention will be further discussed with reference to the drawings.

Figure 1:
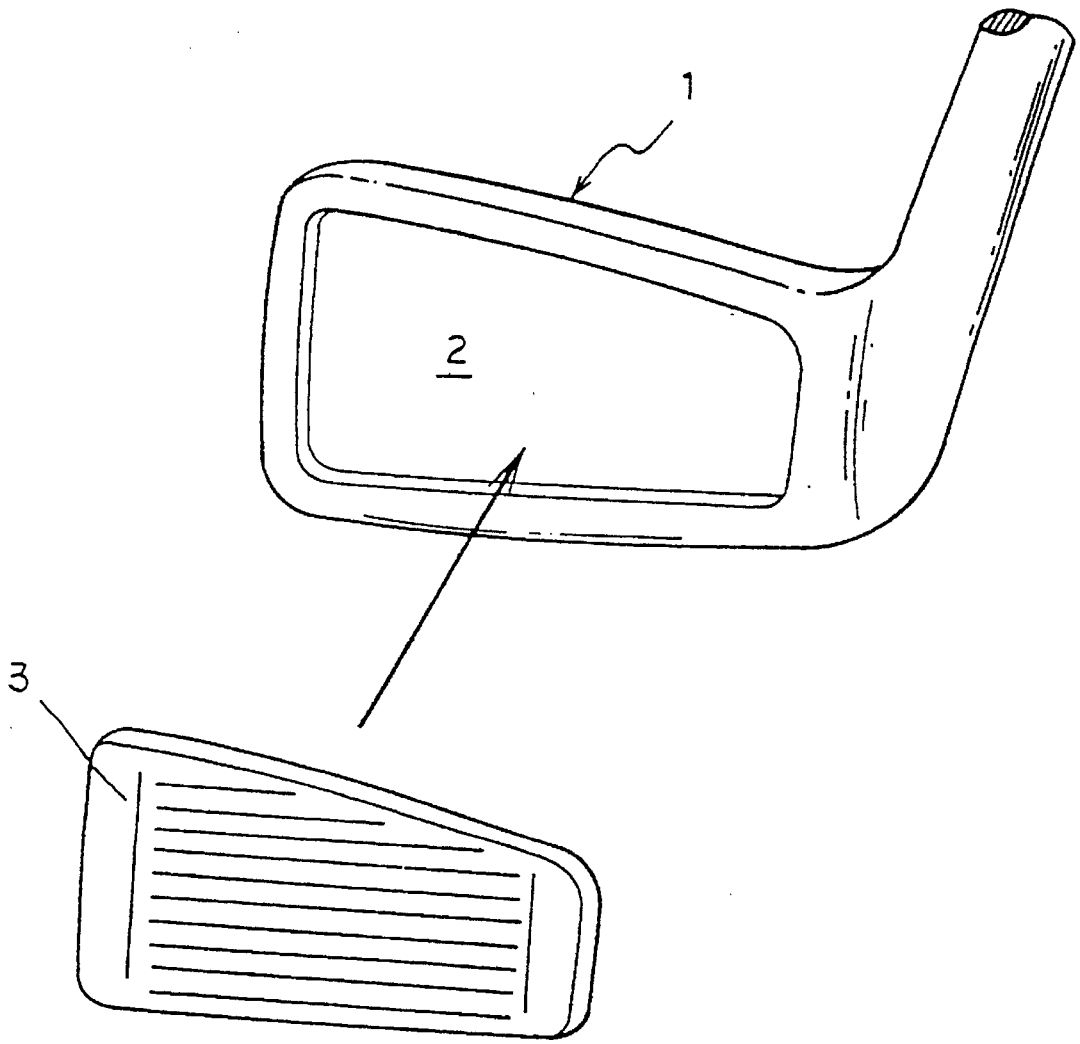
FIG. 1 is a perspective view of a preferred embodiment of the present invention.

According to the embodiment shown in FIG. 1, head body 1 made of a stainless steel or iron by casting or forging has formed in the striking face thereof a concavity 2 in which a face insert 3 made of copper or a copper alloy is fixed. The head body 1 may be made of a synthetic resin such as CFRP or the like. Also, the bottom of the concavity 2, that is, the back face of the head body 1, may be omit ted to form a through-hole extending from the front face to the back face, and the face insert 3 may be fixed in the through-hole.

Figure 2:
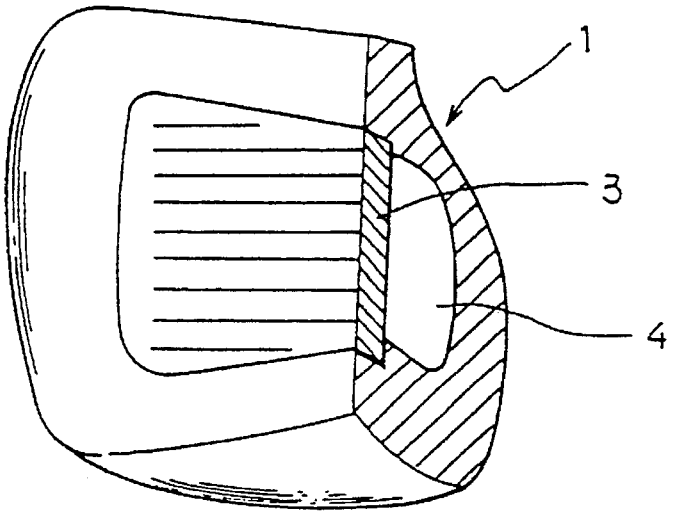
FIG. 2 is a perspective view of another preferred embodiment with a sectional view of the head body.

According to the second embodiment shown in FIG. 2, the face insert 3 made of copper or a copper alloy is fixed in the striking face of the head body 1 and a cavity 4 is formed behind the face insert 3 in the head body 1.

Figure 3:
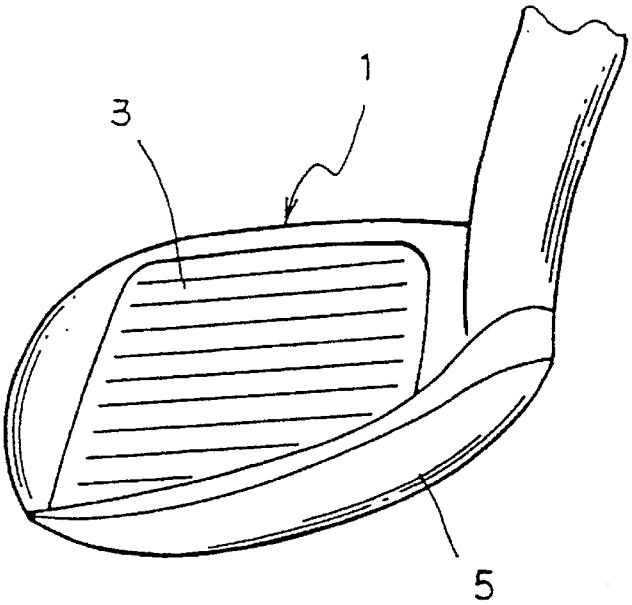
FIG. 3 is also a perspective view of yet another preferred embodiment.

According to the third embodiment shown in FIG. 3, the head body 1 is made of a synthetic resin such as CFRP or the like. The head body 1 has a sole 5 made of a metal such as stainless steel, and a face insert 3 made of copper or a copper alloy and fixed in the striking face.

Further, in another embodiment, the head body 1 including the striking face is made of a stainless steel, iron or titanium alloy or the like by casting or forging, and the striking face made of any material other than copper or copper alloy such as stainless steel or the like is copper-plated to a thickness of 10 to 12 μm. Similar to the club head having fixed in the striking face a face insert made of copper or copper alloy, the club head thus made can generate an increased back spin on the ball. Also the striking face made of a CFRP may be copper-plated.

Figure 4:
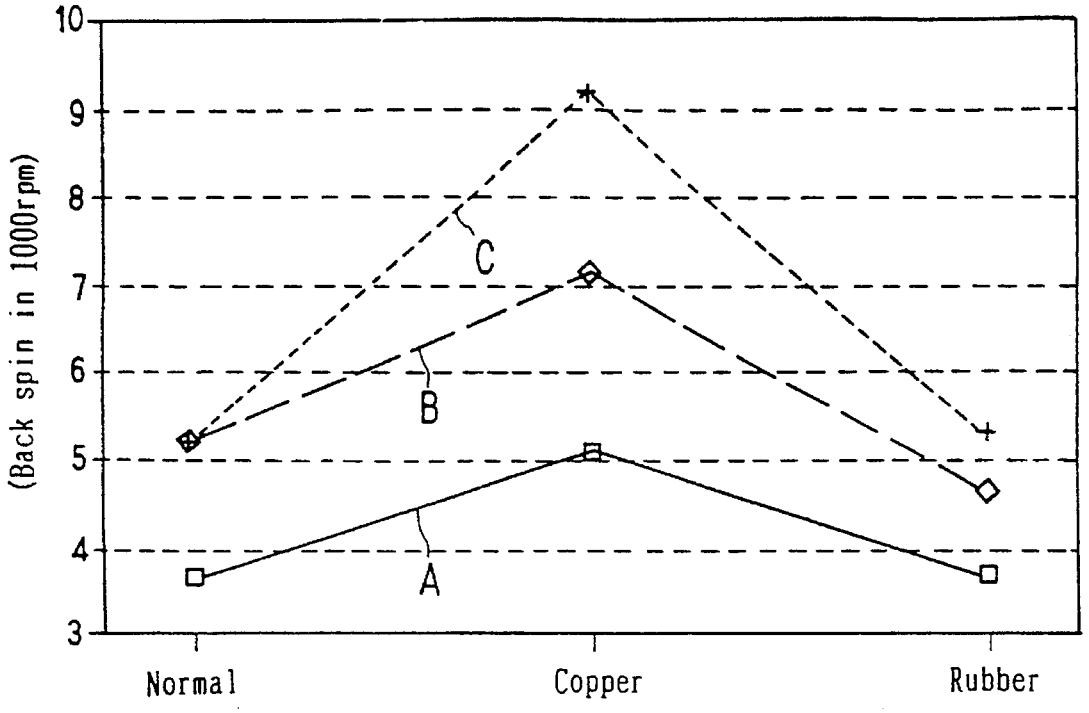
FIG. 4 is a graph showing the resulting back spin on the ball struck by different golfers, respectively, with golf club heads of which the striking faces were made of iron, copper and rubber, respectively.
Figure 5:
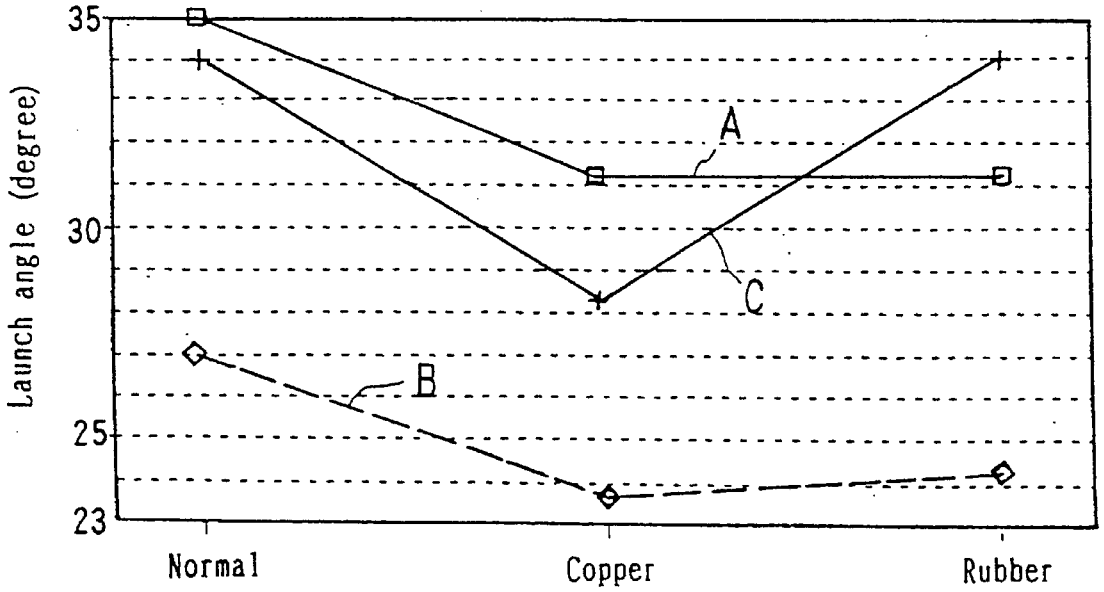
FIG. 5 is a graph showing the differences in the launch angle of the ball struck by the same golfers with the same golf club heads as in FIG. 4.
Figure 6:
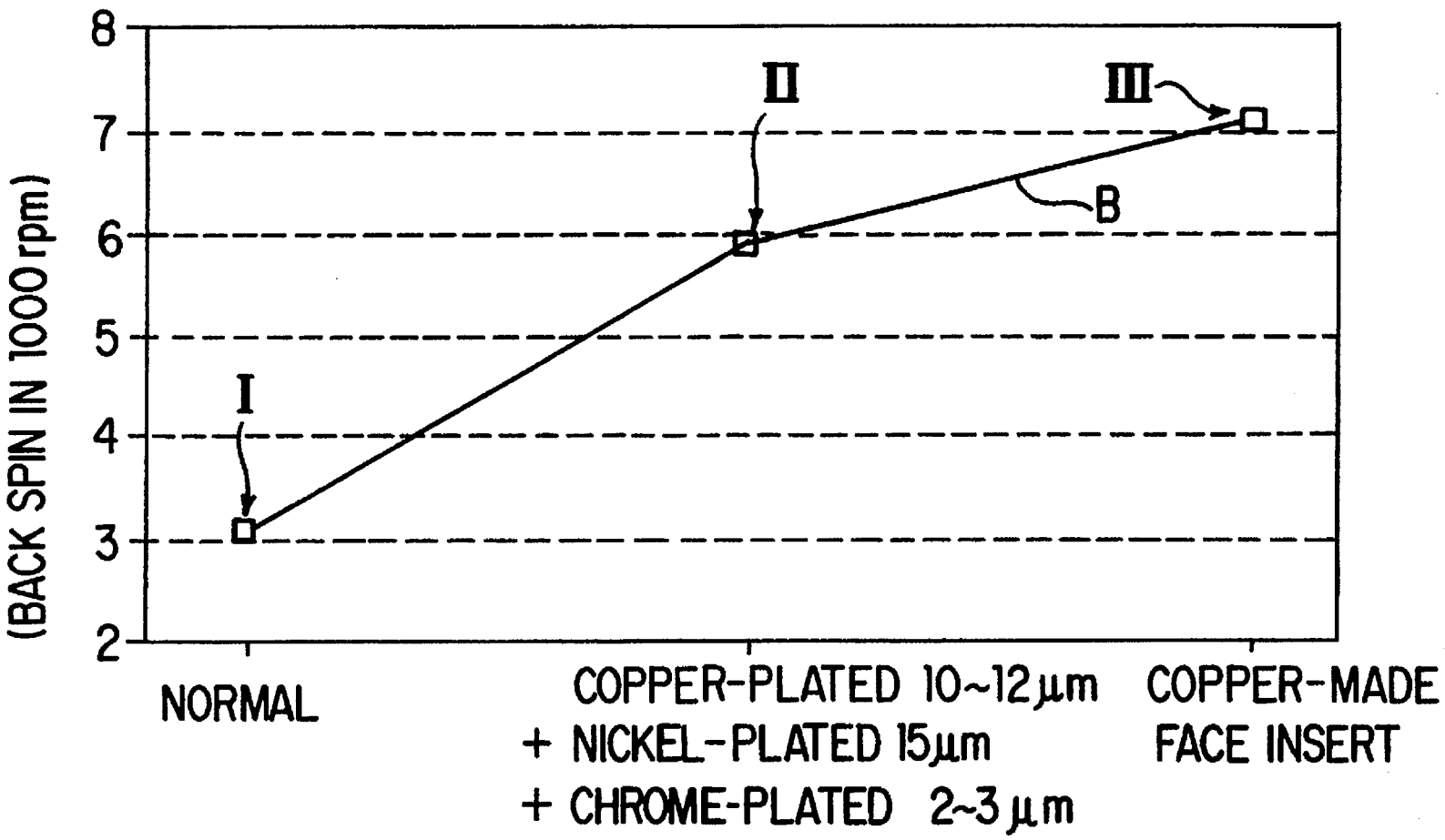
FIG. 6 is also a graph showing the back spin generated on the ball struck by the average golfer B with golf club heads of which the striking faces are made of an iron, copper-plated and having a copper-made face insert, respectively, the golf clubs being equivalent to a No. 9 iron.

In all these embodiments of the present invention, the copper layer of the striking face may be nickel-plated to a thickness of about 15 μm and further the nickel layer may be chrome-plated to a thickness of 2 to 3 μm to protect the face area. The striking face, made of copper or a copper alloy or plated with copper or a copper alloy, of the head of iron clubs called "short-irons" among those having a head of which the face height is larger than the sole width, generates more back spin than that of the conventional golf club heads. It is believed that this increased back spin is owing to the lower hardness of the copper than that of the stainless steel or iron. As seen from FIG. 4, however, the results of the experiments by the Inventor proved that the back spin imparted to the ball struck with a club head having a rubber-made striking face was nearly the same as that to the ball struck with a normal club head (of a No. 9 iron, made of a soft iron by forging). Therefore, it cannot be said that a lower hardness of the striking face absolutely contributes to a more back spin. However, it was proved that use of copper on at least the striking face of the club head increased the back spin. In addition, a No. 9 iron having a club head having a normal striking face, a one having a copper-made striking face and a one having a rubber-made striking face, were used to test the differences in the launch angle among them. The results shown are in FIG. 5. As seen, the launch angle of the ball struck with the No. 9 irons having the copper- and rubber- made striking faces were smaller than that with the No. 9 iron having the normal striking face and the No. 9 iron having the copper-made striking face launched the ball at the smallest angle. FIG. 6 graphically shows the back spin generated on the ball struck by the average golfer B with three golf clubs all equivalent to a No. 9 iron, one (I) of them having a club head made of a soft iron by forging, that is, having a normal striking face, the second (II) having a club head made itself of a soft iron by forging and of which the striking face is plated with copper to a thickness of 10 to 12 μm, and further plated with nickel to a thickness of 15 μm and then plated with chromium to a thickness of 2 to 3 μm and the third (III) having a club head with a 1 mm-thick, copper-made face insert in the striking face. As seen, the club head with the copper-plating on the striking face generates a considerably increased back spin.

of test hitting were measured. The average back spin value with each of the four iron clubs having the different face inserts are as shown in Table 1 below. The back spins were measured by using the "high speed instantaneous multi-image recorder" described in U.S. Pat. No. 4,713,686. This recorder uses a CCD camera and high speed strobe to record a struck ball as multiple images into a memory. The images are digitized to measure the back spins.

TABLE 1

| Back Spins | | |
|---|---|---|
| Material (of face insert) | Hardness (HRB) | Back spin (rpm) |
| Copper | 35 to 40 | 7,100 |
| Soft iron (S25C) | 82 to 90 | 5,200 |
| Stainless steel (SUS630) | 107 | 5,200 |
| Stainless steel (SUS304) | 70 to 90 | 5,400 |

In Table 1, the stainless steels SUS630 and SUS304 contain the chemical components shown in Table 2. The SUS304 stainless steel is of an austenite type. The hardness "HRB" stands for Hardness Rockwell B scale.

TABLE 2

| | Chemical Components of SUS630 and SUS304 | | | | | | | | |
|---|---|---|---|---|---|---|---|---|---|
| | C | Si | Mn | P | S | Ni | Cr | Cu | Nb |
| SUS630 | 0.07 or less | 1.00 or less | 1.00 or less | 0.040 or less | 0.030 or less | 3.00 to 5.00 | 15.00 to 17.50 | 3.00 to 5.00 | 0.15 to 0.45 |
| SUS304 | 0.08 or less | 1.00 or less | 2.00 or less | 0.045 or less | 0.030 or less | 8.00 to 10.50 | 18.00 to 20.00 | — | — |

In the experiments by the Inventor, the professional golfer C used a No. 9 iron having normal club head and one with a club head having a copper-made striking face. The initial launching speed of the ball struck with the normal iron was 42.7 m/sec, and that of the ball struck with the iron having the copper-made striking face was 44.7 m/sec. The head speed of the normal iron was 37.9 m/sec, and that of the iron having the copper-made striking face was 38.8 m/sec. Furthermore, the flight distance of the ball struck with the normal iron was 183.3 yards, and that of the ball struck with the iron having the copper-made striking face was 135 yards.

In additional experiments, as embodiments of the present invention, four types of No. 9 iron clubs each with a head having the structure shown in FIG. 1 were prepared. The head of one of the four iron clubs was provided with a face insert made of a copper having a hardness falling within a range of 35 to 40 on the Rockwell B scale ("HRB") while the heads of the other three clubs were provided with face inserts, respectively, made of a soft iron (S25C) and two kinds of stainless steel (SUS630 and SUS304), respectively. In all these No. 9 iron clubs, the lie angle of the club head was 60°, the loft angle was 43°, club length was 35.5 inches and the balance was C9. Data was collected on the iron club heads through experimental hitting with these clubs. A person who swung these clubs with an average head speed of 37 m/sec tried ten times of test hitting with each of these four types of No. 9 iron clubs. The back spins imparted to balls when struck by him with the iron clubs in the ten times As having been described the foregoing, the club head of, especially, clubs called "short iron" having at least the striking face made of copper or a copper alloy or plated with copper or a copper alloy according to the present invention can impart an increased back spin to the ball which in turn will stop very quickly after landing.

In the embodiments shown in FIG. 5, 1 to 3, the face insert 3 separated from the head body 1 is fixed in a predetermined place such as the concavity 2 in the head body 1. As previously mentioned, however, the club head may be made of a single kind of material and the striking face thereof may be plated with copper or a copper alloy. Also, the face insert 3 made of copper or a copper alloy and the area to be plated with copper or a copper alloy may be nearly the same in size as the sweet spot. Furthermore, the face insert 3 may be made of any material other than copper or a copper alloy and plated with copper or a copper alloy.

What is claimed is:

1. A golf club head having a face height larger than a sole width, and having at least a striking face made of copper or a copper alloy or plated with copper or a copper alloy, said striking face having a hardness not greater than 60 on the Rockwell B scale.

2. A golf club head according to claim 1, wherein the striking face is nickel-plated and chromium-plated on the nickel plate.

3. A golf club head having a striking face, made of any material other than copper or a copper alloy, plated with copper or a copper alloy to a thickness of 10 to 12 μm, plated with nickel on the copper or copper alloy plate to a thickness of about 15 μm and plated with chromium on the nickel plate to a thickness of 2 to 3 μm, said striking face having a hardness not greater than 60 on the Rockwell B scale.

* * * * *